United States Patent [19]

Nestel-Eichhausen

[11] Patent Number: 4,776,569

[45] Date of Patent: Oct. 11, 1988

[54] TWIN COLUMN HOIST

[76] Inventor: Michael Nestel-Eichhausen, Kasern 14, Salzburg, Austria

[21] Appl. No.: 77,077

[22] Filed: Jul. 24, 1987

Related U.S. Application Data

[63] Continuation of Ser. No. 834,248, filed as PCTEP85/00281, Jun. 13, 1985, published as WO86/00063, Jan. 3, 1986, abandoned.

[30] Foreign Application Priority Data

Jun. 13, 1984 [DE] Fed. Rep. of Germany ..... 3421959

[51] Int. Cl.[4] ..... B66F 7/12

[52] U.S. Cl. ..... 254/89 R; 254/DIG. 4; 254/133 R

[58] Field of Search ..... 254/89 R, 89 H, 92, 254/3 R, 98, 133 R, DIG. 4

[56] References Cited

U.S. PATENT DOCUMENTS 4,024,960 5/1977 Forster .
4,295,427 10/1981 Waterman et al. .

FOREIGN PATENT DOCUMENTS 45488 2/1976 Australia .
757664 12/1970 Belgium .
1556381 7/1970 Fed. Rep. of Germany .
7117555 10/1971 Fed. Rep. of Germany .
2122335 11/1972 Fed. Rep. of Germany .
2637213 11/1977 Fed. Rep. of Germany .
0035989 9/1981 Fed. Rep. of Germany .
3244318 8/1983 Fed. Rep. of Germany .
3208750 9/1983 Fed. Rep. of Germany .

*Primary Examiner*—Frederick R. Schmidt
*Assistant Examiner*—Judy J. Hartman
*Attorney, Agent, or Firm*—Davis, Bujold & Streck

[57] ABSTRACT

A stationary twin column hoist to be used for raising vehicles, in which each column is fitted with a height-adjustable carriage, this carriage having two carrier arms which can be adjusted for length and which can be spread apart relative to each other, these being used to support the vehicle. In order to simply work that is carried out on the body of such a vehicle the present invention proposes that the pairs of rotating arms be connected with the carriages by an adjusting system each of these adjusting systems being pivotable about a common horizontal axis. Addition holding devices are provided so as to ensure the additional security of the vehicle. Using the present invention it is possible to convert existing twin column hoists without any major expenditure.

5 Claims, 2 Drawing Sheets

TWIN COLUMN HOIST

This is a continuation of co-pending application Ser. No. 834,248 filed as PCT EP85/00281 on Jun. 13, 1985, published as WO86/00063 on Jan. 3, 1986, now abandoned.

The present invention relates to a stationary twin column hoist used for raising motor vehicles, this being in accordance with the defining portion of patent claim 1.

A twin column hoist has two stationary columns, a carriage which can be adjusted for height and having in each instance two spreadable carrier arms being arranged on each column. The carrier arms have at their ends supports, e.g., supporting plates, which support the vehicle that is to be raised at a single point. The carriages for the pairs of carrier arms can be adjustable synchronously along the length of columns so that the vehicle can be raised to the desired height, after which the whole of the vehicle body work is readily accessible.

Even though stationary twin column hoists of this kind provide for a high level of working convenience and comfort and simplify any work that has to be done on the underside of the vehicle, they do however entail the disadvantage that such work must often be carried out with the body twisted into an uncomfortable position, particularly with regard to the position of the head.

DE GM No. 71 17 555 describes a device used for raising and turning a motor vehicle. This device has two movable stands that are adjusted against the front and the rear of the vehicle so that the vehicle is positioned in the center of the stands. Each stand has a carrier that can be adjusted with regard to height and which is positioned transversely to the longitudinal axis of the vehicle. This can in addition be pivoted about an axis that is parallel to the central longitudinal access of the vehicle. The free end of the tilting arms of both the stands are connected to longitudinal girders that can be adjusted for length. The vehicle is raised with a jack. Then one wheel after the other is removed and the hub which is thus exposed is secured to mountings that can be adjusted along the longitudinal girders. When all of the four hubs have been secured the vehicle can be raised by means of a threaded drive or by means of motors on the stands. Once the vehicle has been raised to a sufficient height the tilt arms can be displaced about the above-described axis, e.g., by means of a cam and gear drive, so that the vehicle can be twisted about its central longitudinal axis either to the left or to the right. This means that the bottom of the vehicle body can be made readily accessible for work.

This familiar device is relatively costly from the point of view of operation. The work required to install the vehicle on the hoist is involved. Furthermore, the system requires specially manufactured stands that are not, as a rule, available in a workshop.

The present invention undertakes the task of configuring a stationary twin column hoist such that in particular overhead work can be avoided without the ease of operation of such a hoist being restricted.

According to the present invention this task is solved by the features that are described in the present claims.

According to this, a conventional stationary twin column hoist need be only slightly modified in order to bring a motor vehicle to a specific height and then rotate it about a transverse axis so that the working field is almost directly in the line of vision of a mechanic.

Using the proposed twin column hoist the vehicle is raised in the normal manner, i.e., the carrier arms that are secured to the carriages and pivoted beneath the floor of the bodywork of the vehicle and finally the carriages are adjusted for height until they rest against the floor of the vehicle. Thus no special hoist is needed to raise the motor vehicle. Next the securing system is connected to a fixing point on the vehicle. A safe solution lies in the fact that after the vehicle has been raised, two of the wheels are removed and a slotted flange is then fixed on the exposed threaded trunion of the brake drums, this being connected with a connector arm with the point of articulation of the pivot arms on the carriages.

Finally, the carriages are raised in the normal manner to the required working height. Once in the desired working height the adjusting devices are operated synchronously so that the vehicle is pivoted transversely to its longitudinal direction. Since conventional stationary twin column jacks are usually operated either hydraulically or pneumatically, hydraulic or pneumatic adjusting motors are also provided for this pivotting action. In the same way it is also possible to provide this tilting action by means of an operating cylinder that is connected to a rotating bearing for the carrier arms.

The invention is described on the basis of an exemplary version which is shown in the drawings. These drawings are as follows.

Figure 1:
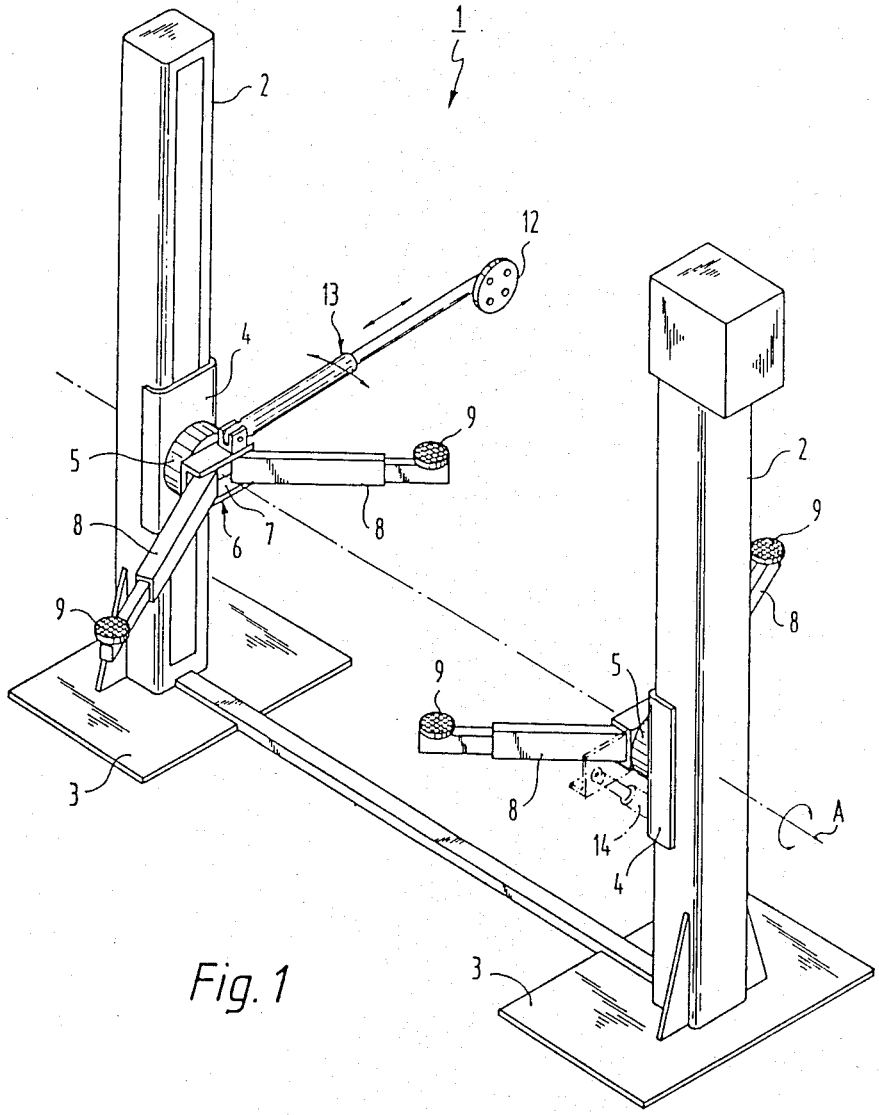
FIG. 1 is a perspective schematic drawing of a twin column hoist according to the invention.

A stationary twin column hoist 1 had two vertical columns 2 which are in each instance connected by means of a base plate 3 to the floor of a motor vehicle workshop. A carriage 4 can be adjusted longways on each of the two columns 2. Usually, this adjustment is carried out with the help of a threaded drive or else hydraulically. An adjusting motor 5 is connected with each carriage 4, the rotating portion 6 of which can be pivoted about a horizontal axis A. This axis of rotation A is common to both the adjuster motors. A support frame 7 is secured to each rotating portion 6, and on both ends of this there is in each instance a carrier arm 8 articulated in such a manner as to permit it to rotate. The carrier arms 8 that can be adjusted for length have in each instance a supporting plate 9 at their ends.

A motor vehicle 10 (FIG. 2) is driven between the two columns 2 with the carriages 4 in the lowered position, and finally the horizontally mounted carrier arms 8 are pivoted beneath the vehicle with the help of the adjusting motors 5 such that the supporting plates 9 are positioned under a safe point of the bodywork of the vehicle (10).

Figure 2:
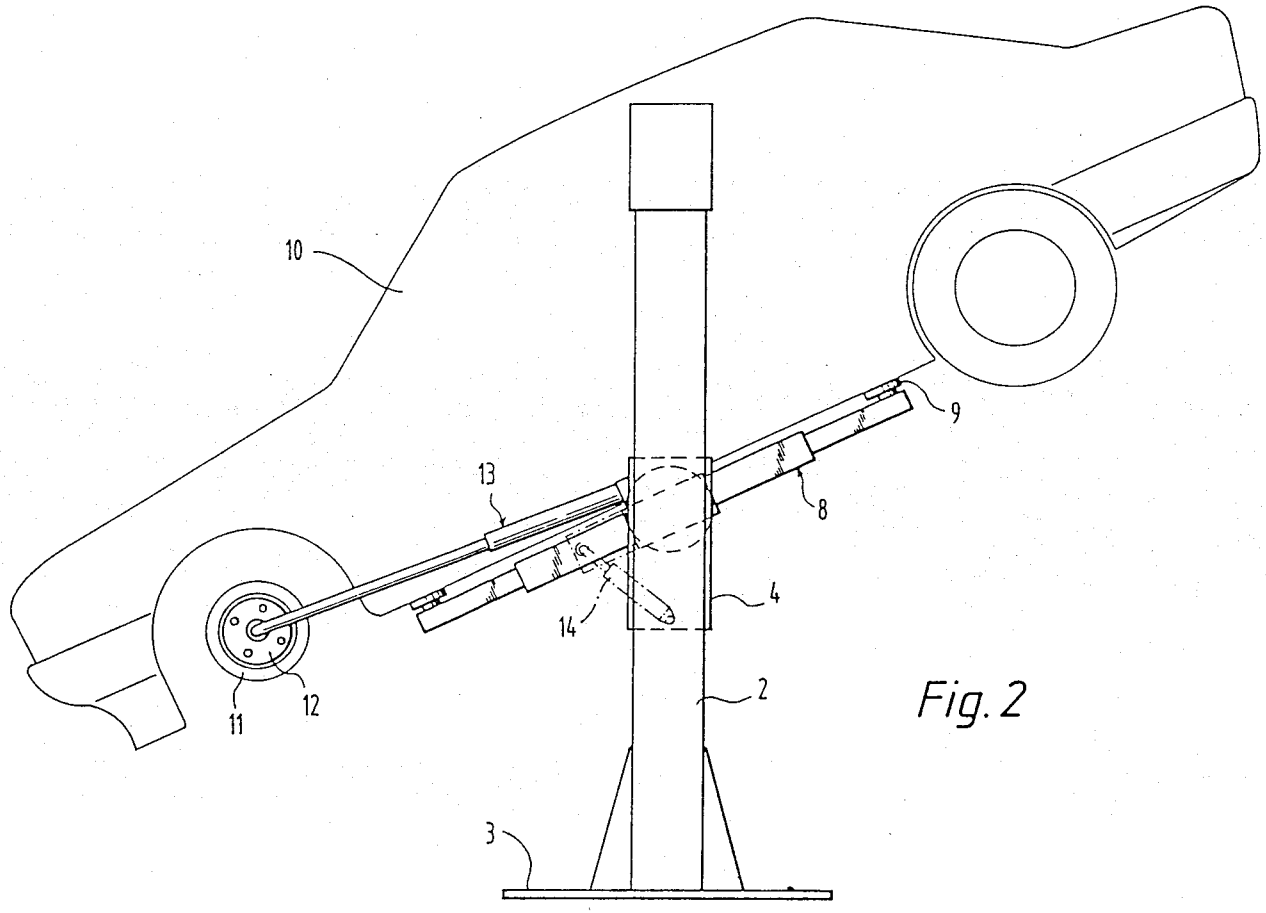
FIG. 2 is a side view of a twin column hoist with a motor vehicle positioned on it.

Finally, the vehicle is raised slightly so that the wheels, for example, the front wheels 11, can be removed. A slotted plate 12 is then installed in the exposed threaded bolts and tightened into position; this slotted plate is connected to the supporting frames 7 through a connecting arm 13 that can be adjusted for length and then locked, in such a manner as to permit it to pivot. Thus the vehicle 10 is fixed into position on the two column hoist 1. FIG. 1 shows only one of the connecting arms 13 with the slotted flange 12 that is used. The vehicle that is fixed on the two column hoist 1 in this manner is raised to the required working height in the usual way by the synchronized motion of the carriages 4 and then pivoted about the axis A that is common to the two adjuster motors switching on the adjuster motors 5. The vehicle can be moved into an inclined position as is shown in FIG. 2.

As is shown by the dashed line in FIG. 1 the pivoting of the pairs of carrier arms about the axis A can also be affected by means of a linkage, e.g., with the help of a hydraulic cylinder 14, this being installed between the carriages 4 and the supporting frame 7 that is lengthened if necessary.

The embodiments of the invention in which an exclusive property or privilege is claimed are defined as follows:

1. A stationary twin column hoist used for raising and lowering a vehicle comprising a base member and a pair of vertically spaced columns each being attached to the base member, each column supporting a carriage capable of guided vertical movement relative to said columns, each said carriage supporting a rotatable support frame, adjusting means attached to said carriage providing rotational movement of said support frame about a horizontal axis when desired, each said support frame carrying a pair of spreadable carrier arms which are length adjustable and pivotally connected to said support frame at one end to provide adjustment to accommodate different vehicles, each said carrier arm having support means at its free end for supporting said vehicle, lifting means being connected to said carriages for said vertical movement of said carriages when desired, and each said support frame further carrying at least one connecting arm to extend substantially longitudinal along a side of a said vehicle when supported by said support means, means for adjusting said connecting arms to any desired fixed length, said connecting arm having slotted plate means at its free end suitable for connection to a wheel hub portion of said vehicle to prevent the vehicle from sliding off said support means.

2. A twin column hoist according to claim 1, wherein said adjusting means comprises at least one hydraulic cylinder connected between the carriage and support frame of each column to provide rotation of the support frame when desired.

3. A twin column hoist according to claim 1, wherein the adjusting means comprises a motor interconnecting said carriage with said support frame and providing rotational movement to said support frame when desired.

4. A twin column hoist according to claim 1, wherein the carrier arms are connected to the support frame in an articulated manner.

5. A stationary twin column hoist used for raising and lowering a vehicle comprising a base member and a pair of vertically spaced columns each being attached to the base member, each column supporting a carriage capable of guided vertical movement relative to said columns, each said carriage supporting a rotatable support frame, adjusting means attached to said carriage providing rotational movement of said support frame about a horizontal axis when desired, each said support frame carrying a pair of spreadable carrier arms which are length adjustable and pivotally connected to said support frame at one end to provide adjustment to accommodate different vehicles, each said carrier arm having support means at its free end for supporting said vehicle, lifting means being connected to said carriages for said vertical movement of said carriages when desired, and each said support frame further carrying at least one connecting arm to extend substantially longitudinal along a side of a said vehicle when supported by said support means, means for adjusting said connecting arms to any desired fixed length, said connecting arm having securing means at its free end suitable for restraining a wheel hub of the vehicle to prevent the vehicle from sliding off the support means.

* * * * *